United States Patent [19]

Mendelson

[11] 4,380,215

[45] Apr. 19, 1983

[54] LIQUID FUEL-FIRED WATER HEATING TANK

[76] Inventor: Walton L. Mendelson, 3161 Yorkshire, Cleveland Heights, Ohio 44118

[21] Appl. No.: 284,064

[22] Filed: Jul. 16, 1981

[51] Int. Cl.[3] ..... F22B 5/00

[52] U.S. Cl. ..... 122/13 R; 122/17; 122/19; 122/182 R; 122/161; 122/44 A; 122/155 A

[58] Field of Search ..... 122/13 R, 14–19, 122/44 A, 45, 155 A, 74–76, 158–162, 164, 184, 182 R

[56] References Cited

U.S. PATENT DOCUMENTS

| | | | |
|---|---|---|---|
| 665,658 | 1/1901 | Jankus | 122/155 A |
| 1,691,008 | 11/1928 | Griswold | 122/19 |
| 1,802,578 | 4/1931 | Schnepp | 122/19 |
| 2,077,776 | 4/1937 | Schmitt | 122/44 A |
| 2,355,466 | 8/1944 | Perry | 122/17 |
| 2,383,924 | 8/1945 | Way et al. | 122/182 R |
| 2,552,044 | 5/1951 | Huet | 122/161 |
| 2,787,256 | 4/1957 | Ilune | 122/161 |
| 3,638,622 | 2/1972 | Ostbo | 122/182 R |
| 4,170,963 | 10/1979 | Siegrist | 122/182 S |
| 4,192,260 | 3/1980 | Ostbo | 122/182 R |

FOREIGN PATENT DOCUMENTS

| | | | |
|---|---|---|---|
| 2328522 | 12/1973 | Fed. Rep. of Germany | 122/182 R |
| 54-129201 | 10/1979 | Japan | 122/17 |
| 897424 | 5/1962 | United Kingdom | 122/13 R |
| 909409 | 10/1962 | United Kingdom | 122/182 R |

*Primary Examiner*—Henry C. Yuen

*Attorney, Agent, or Firm*—Body, Vickers & Daniels

[57] ABSTRACT

A water heating tank is disclosed which includes an annular water receptacle having a vertical passageway extending centrally therethrough and opening at its lower end into a plenum chamber beneath the receptacle. An annular combustion chamber assembly extends downwardly into the passageway from the upper end thereof and is removably mounted on the receptacle together with an oil-fired burner unit having a burner tube extending downwardly into the combustion chamber. A removable baffle assembly is disposed in the passageway between the combustion chamber and plenum chamber, and a circumferentially narrow exhaust flue extends vertically along the outer side wall of the receptacle and has an inlet end opening radially into the plenum chamber.

2 Claims, 6 Drawing Figures

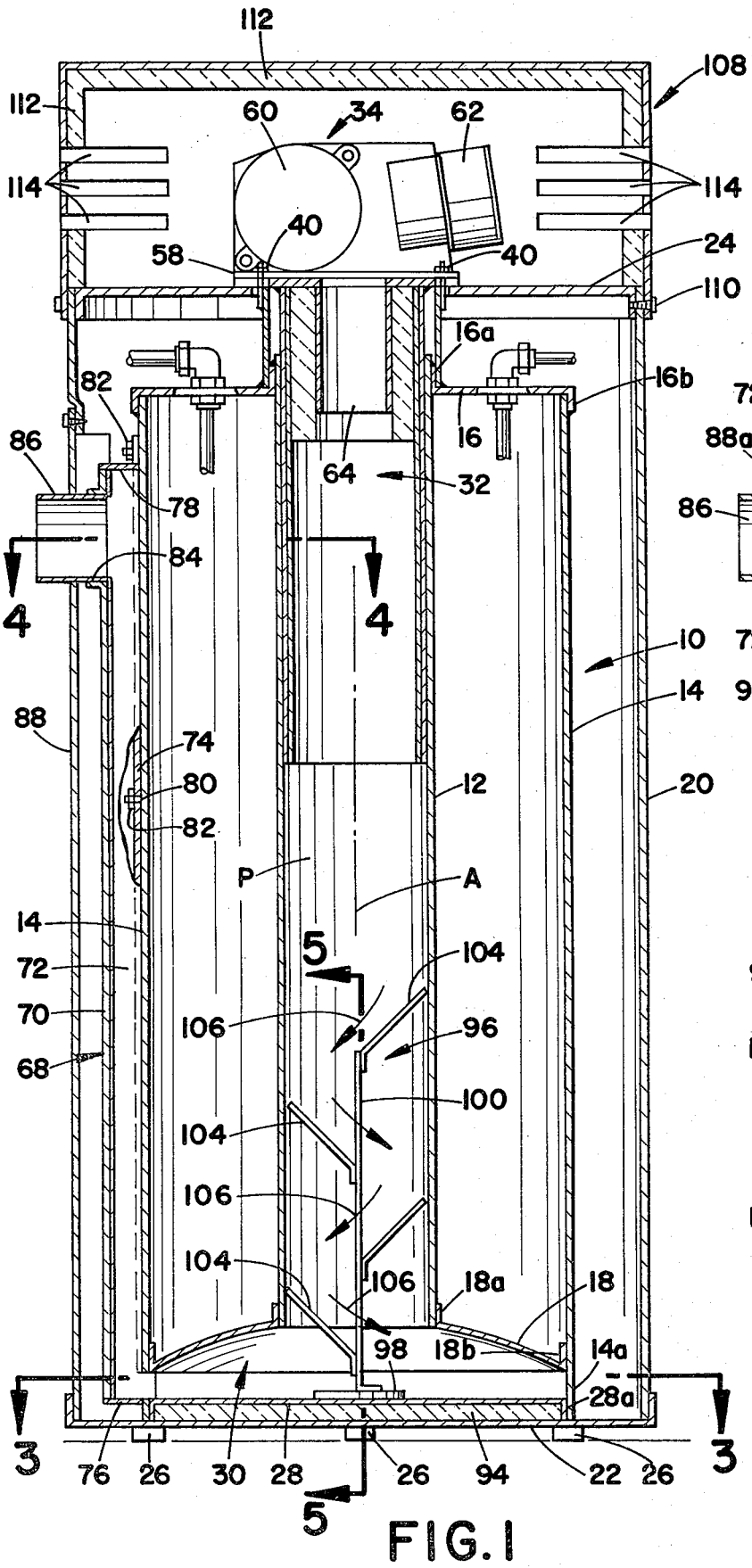
FIG. 1
FIG. 4
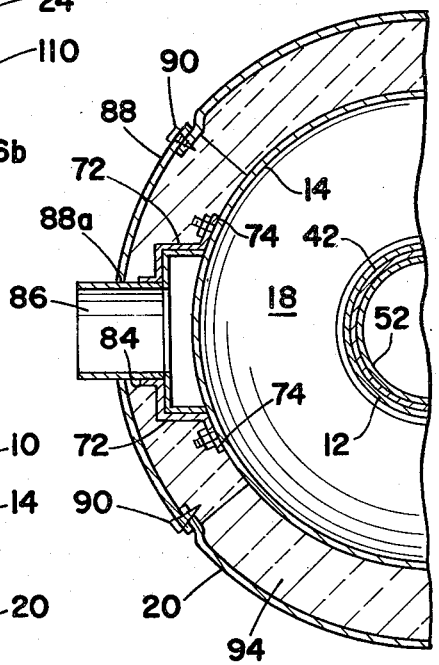
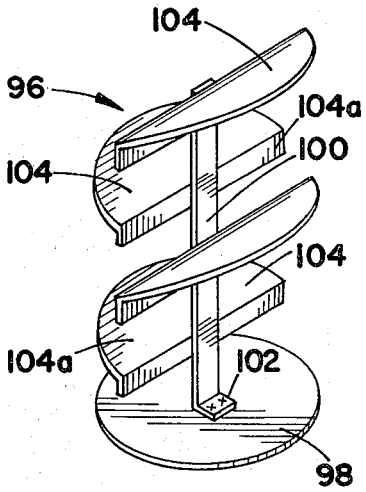
FIG. 6

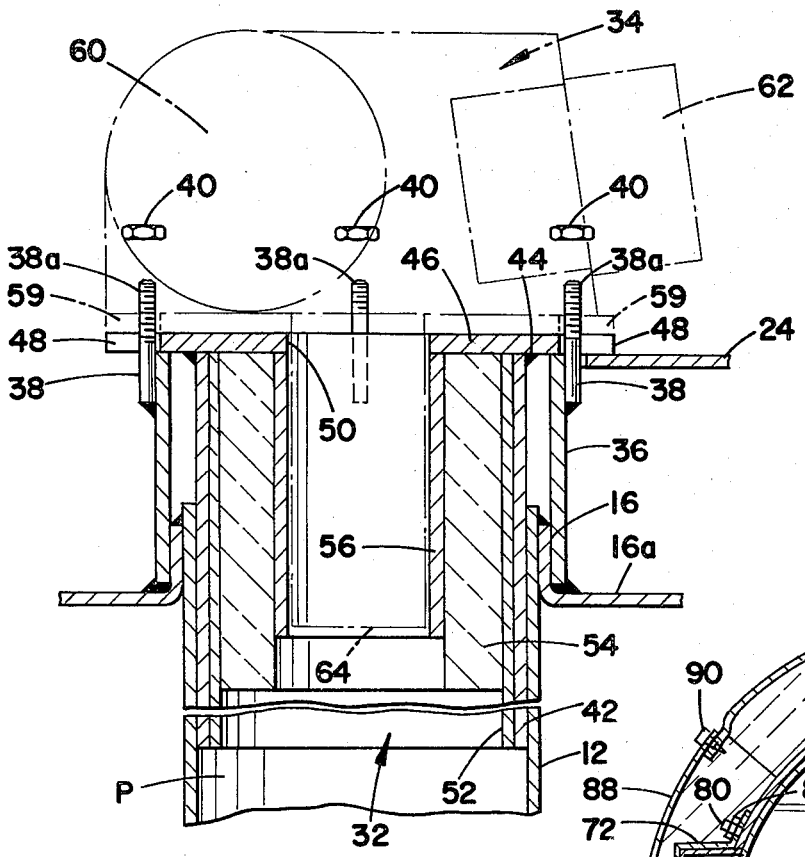
FIG. 2
FIG. 3
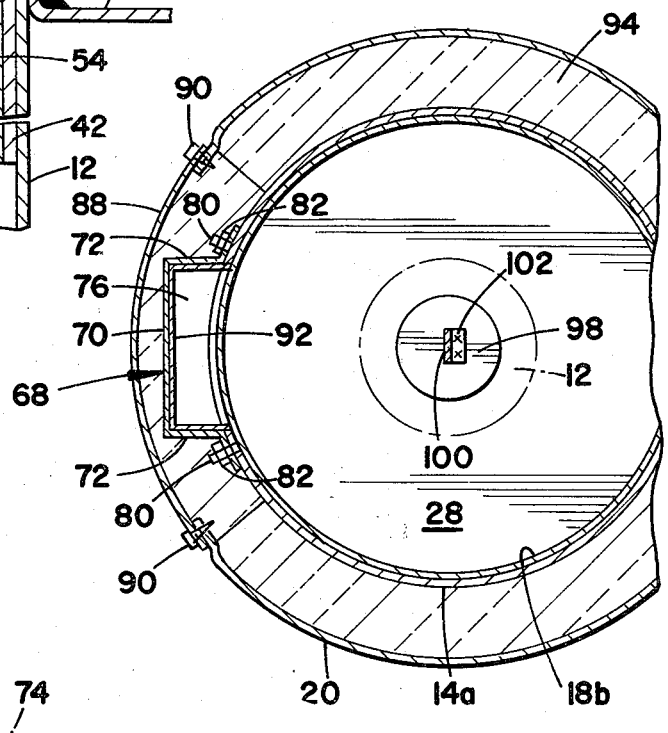
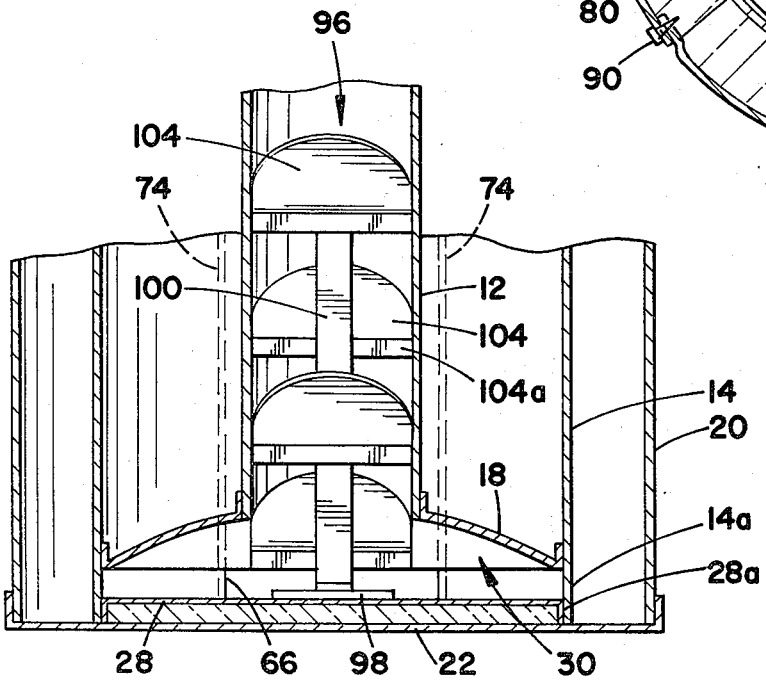
FIG. 5

LIQUID FUEL-FIRED WATER HEATING TANK

BACKGROUND OF THE INVENTION

The present invention relates to the art of liquid fuel-fired water heating tanks and, more particularly, to a down-fired water heating tank.

Liquid fuel-fired water heating tanks are of course well known, and it is likewise well known that certain such water heating tanks heretofore provided include an annular upright water receptacle having a vertical exhaust flue or passageway centrally therethrough, a combustion chamber beneath the receptacle, and communicating with the central exhaust flue, and a liquid fuel-fired burner unit radially associated with the combustion chamber and having a burner tube opening radially thereinto. During operation, a fuel-air mixture is ignited and burns in the combustion chamber to heat water in the receptacle, which heating is supplemented by the flow of hot exhaust gases upwardly through the exhaust flue to an external exhaust duct. The location of the combustion chamber at the bottom of the water receptacle, however, results in considerable loss of usable heat by the flow of hot gasses upwardly through the exhaust flue. Therefore, the heating efficiency is lower than is desired with respect to heating water in the receptacle, whereby more fuel is required to achieve heating of the water and maintenance of the heat thereof at a given temperature. In this respect, it will be appreciated that the burner has to operate for longer periods of time to achieve and maintain desired water temperature levels. Such frequent and extended burner operation not only effects the cost of operating the water heating tank, but also the life of the component parts of the burner assembly and combustion chamber, and thus maintenance costs with respect to the water heating tank.

The burner unit of such bottom fired water heating tanks is removably mounted on the lower outer portion of the housing or jacket of the tank to facilitate removal of the burner unit for maintenance purposes with respect thereto and with respect to the combustion chamber. Removal of the burner unit provides access to the combustion chamber through the burner tube opening, but such access is not convenient for maintenance personnel because of the small size of the opening and the location thereof close to the floor. In this respect, maintenance operations, such as replacement of combustion chamber liners, necessitate reaching into the combustion chamber which is physically difficult and uncomfortable for maintenance personnel. Further, any effort to visually inspect the interior of the combustion chamber is not only limited by the size of the burner tube opening through the housing, but practically requires maintenance personnel to lie on the floor in order to look into the opening. Thus, maintenance operations are time consuming and tedious and at best are limited with respect to a desired thoroughness.

SUMMARY OF THE INVENTION

In accordance with one aspect of the present invention, a liquid fuel-fired water heating tank is provided by which the water heating efficiency is considerably increased in comparison with water heating tanks of the character described above. In accordance with another aspect of the invention, the arrangement and accessibility of the component parts of the heating system of the water heating tank provide for maintenance to be achieved conveniently and with minimum physical discomfort and effort on the part of the person performing such maintenance.

More particularly in accordance with the present invention, a liquid fuel-fired burner unit is mounted at the upper end of an annular water receptacle so as to fire downwardly into the central passageway through the receptacle as defined by the inner wall of the receptacle. A plenum chamber is provided at the lower end of the passageway beneath the receptacle, and the hot gases flow downwardly through the passageway into the plenum chamber and thence into a circumferentially narrow exhaust flue which extends upwardly along the outer wall of the receptacle from the plenum chamber to an external exhaust duct at the upper end of the receptacle. Improved efficiency with regard to heating water in the receptacle results from several factors including the fact that down firing into the central passageway increases the surface area of the water receptacle exposed to the primary heat from the burner unit. Further, the hot gases must flow downwardly and into the plenum chamber before they are free to flow upwardly through the exhaust flue. This, together with the fact that the flow of gases from the plenum chamber into the exhaust flue is somewhat restricted, provides for a controlled flow of hot gases into and through the plenum chamber to optimize heat transfer to water in the receptacle. Still further, disposition of the exhaust flue against the outer wall of the water receptacle provides supplemental heating of the water as the hot exhaust gases move upwardly through the flue. Preferably, an annular combustion chamber assembly surrounds the burner tube of the burner unit and extends downwardly into the passageway therefrom, and a baffle plate assembly is disposed in the passageway between the combustion chamber assembly and the plenum chamber. The combustion chamber advantageously supports combustion and improves combustion efficiency, while preventing excessive heating of the water in the upper portion of the receptacle. The baffle plate assembly advantageously functions to control the flow of hot gases into and through the plenum chamber in connection with optimizing heat transfer to water in the receptacle.

With respect to maintenance of the water heating tank, the burner assembly is removably mounted at the upper end of the receptacle to facilitate removal of the burner unit for maintenance purposes and, in the preferred embodiment, the combustion chamber assembly and the baffle plate assembly are also removable to facilitate cleaning and maintenance thereof as well as cleaning of the passageway. Still further, the vertically extending exhaust flue is preferably removably mounted on the water receptacle and is accessible through a removable cover plate on the shell or housing of the water heating tank. Removal of the exhaust flue facilitates cleaning thereof and, additionally, provides access to the plenum chamber for cleaning the latter.

It is accordingly an outstanding object of the present invention to provide an improved domestic water heating tank of the character having an annular water receptacle in which water is heated by a liquid fuel-fired burner unit.

Another object is the provision of a liquid fuel-fired domestic water heating tank construction which provides for improved water heating efficiency and fuel economy in comparison with liquid fuel-fired water heating tanks heretofore available.

Another object is the provision of a liquid fuel-fired water heating tank including an annular water receptacle having a vertical central passageway therethrough defined by the inner wall of the receptacle, and in which the burner unit is mounted at the upper end of the passageway and is fired downwardly thereinto, and wherein the flow of hot gases through the passageway and ultimately into an external exhaust duct is controlled to optimize heat transfer to water in the receptacle.

Still another object is the provision of a water heater construction of the foregoing character in which the flow of hot gases from the upper end of the receptacle passageway is into a plenum chamber beneath the receptacle and thence into an exhaust flue in heat transfer relationship with respect to the outer wall of the water receptacle, thus to optimize heat transfer to water in the receptacle prior to exhaust of the hot gases to the external duct.

Still another object is the provision of a liquid fuel-fired water heating tank of the foregoing character in which the component parts of the heating system are readily accessible and removable with minimum physical effort and time, thus to facilitate cleaning and other maintenance operations with respect thereto.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which:

FIG. 1 is a sectional elevation view through a water heating tank constructed in accordance with the present invention;

FIG. 2 is an enlarged sectional elevation view of the upper portion of the receptacle and showing the combustion chamber and burner unit mounting arrangement;

FIG. 3 is a cross-sectional view through the plenum chamber of the tank taken along 3—3 in FIG. 1;

FIG. 4 is a cross-sectional view through a portion of the upper end of the receptacle, combustion chamber and exhaust flue taken along line 4—4 in FIG. 1;

FIG. 5 is a sectional elevation view through the plenum chamber and baffle assembly taken along line 5—5 in FIG. 1; and, FIG. 6 is a perspective view of the baffle assembly.

DESCRIPTION OF THE PREFERRED EMBODIMENT

Referring now in greater detail to the drawings, wherein the showings are for the purpose of illustrating a preferred embodiment of the invention only, and not for the purpose of limiting the invention, a water heating tank according to the present invention, as shown in FIG. 1, includes an annular water receptacle 10 having a vertical axis A and comprising coaxial inner and outer cylindrical side walls 12 and 14, respectively, an annular upper end wall 16, and an annular lower end wall 18. Upper end wall 16 has radially inner and outer circumferential flanges **16*a* and 16*b*, respectively, welded to the inner and outer side walls of the receptacle to close the upper end thereof and, similarly, lower wall 18 has radially inner and outer peripheral flanges 18*a* and 18*b* welded to inner and outer side walls 12 and 14 to close the lower end of the receptacle. Receptacle 10 is enclosed in a housing including a cylindrical upright wall member 20 closed at its lower end by an end wall 22, and having a top wall 24. The lower end 14*a* of outer side wall 14 of the receptacle extends below lower end wall 18 and into engagement with housing end wall 22. The water heating tank is supported relative to a floor or the like by means of a plurality of feet 26 mounted on end wall 22 beneath lower end 14*a* of outer side wall 14. The lower end of the water heating tank is further defined by a bottom wall 28 having a peripheral flange 28*a* secured to lower end 14*a* of outer side wall 14 such as by welding. Bottom wall 28 is spaced below lower end wall 18 of the receptacle and, together with end wall 18 and the portion of lower end 14*a* of outer side wall 14 therebetween, provides a plenum chamber 30 into which the lower end of inner side wall 12 of receptacle 10** opens.

Inner side wall 12 of receptacle 10 provides a vertical central passageway P through the receptacle, and the water heating tank further includes a cylindrical combustion chamber assembly 32 extending into passageway P from the upper end thereof, and a liquid fuel-fired burner unit 34, both of which are removably mounted on the upper end of receptacle 10. In this respect, as best seen in FIG. 2 of the drawing, receptacle 10 is provided with an annular mounting collar 36 surrounding flange **16*a* of end wall 16 and suitably secured thereto such as by welding. Collar 36 extends upwardly through an opening therefor in top wall 24 of the housing and is provided adjacent its upper end with a plurality of mounting studs 38 secured thereto such as by welding and having upwardly extending threaded ends 38*a* adapted to receive corresponding nuts 40. Combustion chamber assembly 32 includes an outer sheet metal sleeve 42 having its upper end welded at 44 to a mounting collar 46. Collar 46 is provided about its periphery with radially extending recesses 48 to receive mounting studs 38, and includes a central opening 50 through which the burner tube of burner unit 34 extends, as set forth below. Sleeve 42 of the combustion chamber assembly is provided with a radially thin lining of refractory insulating material 52 which is coextensive therewith, as is provided adjacent its upper end with a radially thick sleeve 54 of refractory insulating material. A suitable material for linings 52 and 54 is an alumina-silica ceramic fiber, such as that marketed by Carborandum Corporation of Niagra Falls, New York under the product name FIBER FRAX. Preferably, the combustion chamber assembly further includes a sheet metal-sleeve 56 within refractory sleeve 54 and welded to collar 46 about opening 50 therethrough. Sleeves 42 and 56 protect the refractory material during mounting and removal of the combustion chamber assembly, and sleeve 56 protects lining 54 during mounting and removal of burner unit 34**.

In the preferred embodiment, burner unit 34 is a standard oil-fired unit for domestic water heating tanks and, as is well known, includes a mounting plate 58 by which the unit, as such, is adapted to be removably mounted on a mounting collar therefor on a water tank which, in the present embodiment, is defined by mounting collar 46. For this purpose, plate 58 has recesses 59 in the periphery thereof which receive mounting studs 38. As is further well known, such a burner unit includes a fan motor 60 for combustion air and a pump 62 for fuel oil, which air and fuel oil are delivered to a nozzle, not shown, disposed in a burner tube 64 which extends from mounting plate 58 and into sleeve 56 of the combustion chamber assembly when the burner is in its mounted position as shown in FIGS. 1 and 2. It will be appreciated of course that a fuel line and ignition line, not shown, are connected to burner unit 34.

As best seen in FIGS. 1 and 3-5 of the drawing, plenum chamber 30 is an annular chamber underlying water receptacle 10 and having an inlet defined by the lower end of inner side wall 12 of the receptacle. The plenum chamber is provided with a circumferentially narrow radial outlet defined by an opening 66 through lower end 14*a* of outer side wall 14 of receptacle 10, and opening 66 communicates with the lower end of a vertically extending circumferentially narrow exhaust flue 68 which is removably secured to outer side wall 14 of receptacle 10. Exhaust flue 68 is of generally U-shaped construction having an outer wall 70 radially spaced from receptacle wall 14 and circumferentially spaced apart side walls 72 terminating in circumferentially extending mounting flanges 74 overlying wall 14. The lower end of flue 68 is closed by an end wall 76, and the upper end of the flue is adjacent the upper end of receptacle 10 and is closed by an end wall 78. It will be appreciated that flue 68 provides the outer walls of an exhaust flue passageway, the inner wall of which is defined by outer side wall 14 of receptacle 10. Preferably, the inner surface of walls 70 and 72 of flue 68 are lined with a refractory insulating material 92 to promote heat transfer to water in tank 10 and to decrease the jacket temperature of the water heater. Material 92 can be the same as that of linings 52 and 54 of the combustion chamber assembly.

Flue 68 is removably mounted on receptacle wall 14 by providing the latter with a plurality of studs 80 having inner ends welded to wall 14 and having threaded outer ends extending through openings in flanges 74 and receiving nuts 82. The upper end of wall 70 of flue 68 is provided with an opening 84 in which is secured a cylindrical exhaust duct 86 having an outer end connectable to external exhaust duct for the water heating tank. Access to flue 68 for purposes of removal thereof is achieved by providing housing wall 20 with a removable panel 88 which can be removably secured to wall 20 in any suitable manner such as by means of a plurality of sheet metal screws 90. Panel 88 is provided with an opening 88*a* through which duct 86 extends. It will be appreciated of course that the space between receptacle 10 and housing walls 20 and 24 is filled with a suitable insulating material such as fiber glass, as designated generally by numeral 94, and that the section of such insulation corresponding to wall panel 88 is separable from the remainder of the insulation to facilitate access to flue 68. The space between bottom wall 28 of plenum chamber 30 and lower end wall 22 of the housing is likewise filled with insulation 94.

Referring now to FIGS. 1, 5 and 6 of the drawing, the water heating tank further includes a baffle assembly 96 in the lower end of passageway P and having a lower end resting on bottom wall 28 of plenum chamber 30. More particularly, baffle assembly 96 includes a base plate 98 on which is mounted a narrow vertically extending baffle support strip 100 having a lower end secured to plate 98 such as by welds 102. A plurality of baffle plates 104 are mounted on support strip 100 in axially spaced apart locations and on opposite sides thereof and, for this purpose, each baffle plate has a mounting flange 104*a* secured to strip 100 such as by welding. Baffle plates 104 are inclined with respect to axis A of passageway P, and axially adjacent ones of the baffle plates incline in diametrically opposite directions with respect to the passageway. The outer peripheral edges of the baffle plates are contoured for the edges to conform with the curvature of passageway P as defined by inner side wall 12 of receptacle 10. The baffle plate arrangement provides for gas to flow therepast towards plenum chamber 30 as indicated by arrows 106 in FIG. 1, and it will be noted that the lowermost baffle plate 104 provides for the gases to be directed into plenum chamber 30 in the direction away from outlet 66 to flue 68. This of course optimizes the accumulation of gases in the plenum chamber and prevents direct flow of gases toward outlet 66. Baffle assembly 96 can be removed from passageway P through the upper end thereof when the burner unit and combustion chamber assembly are removed, thus to facilitate cleaning or other maintenance with regard to the baffle plate assembly.

Preferably, the upper end of the water heating tank assembly is covered by a removable sheet metal bonnet 108, as illustrated in FIG. 1, secured to the upper end of housing wall 20 such as by means of a plurality of sheet metal screws 110. Bonnet 108 is lined internally with suitable heat insulating material 112, such as fiber glass, thus insulating the ambient area adjacent the water heating tank from heat and sound. The bonnet is provided with suitable openings 114 therethrough for combustion air for burner unit 34 as well as for directing ambient air across the burner for cooling purposes.

When it is necessary or desirable to perform maintenance operations such as cleaning the component parts of the water heating tank, removal of bonnet 108 provides access to the burner unit and combustion chamber assembly which are easily removed by removing nuts 40 from mounting studs 38 and then sequentially removing burner unit 34 and then combustion chamber assembly 32. It will be noted that top wall 24 of the housing advantageously provides a flat surface for tools and the like during such removal operation. Once the burner unit and combustion chamber assembly are removed, baffle plate assembly 96 can be readily withdrawn from passageway P such as by a piece of wire having a hook on the lower end thereof for engaging support strip 100 of the assembly. With further regard to performing maintenance, housing panel 88 can be removed to facilitate access to flue 68 which is readly removable by removing nuts 82 from studs 80, and removal of flue 68 enables access to plenum chamber 30 for cleaning the latter such as by means of a suitable suction device and/or wiping the interior thereof with a cleaning rag.

With regard to the operation of the water heating tank, the fuel-air mixture is ignited in burner tube 64 and burns downwardly in combustion chamber 32, whereby water in the upper portion of receptacle 10 is heated by heat transfer through the combustion chamber and inner side wall 12 of the receptacle. The hot gases flow downwardly through passageway P, whereby the water is further heated by heat transfer through wall 12 below the combustion chamber. The flow of gases into plenum chamber 30, and thence through exhaust flue 68, provides for further heating of water through lower end wall 18 of the receptacle and through the portion of outer side wall 14 of the receptacle along which flue 68 extends. With down firing in the foregoing manner, it has been found that the external exhaust duct temperature is reduced by about 240° F. to 280° F. in comparison with a bottom fired water heating tank in which the combustion chamber is disposed below the water receptacle and the central passageway defines the internal portion of the exhaust flue. Further, in comparison with a heater of the latter character, a down-fired heater in accordance with the present invention has shown an increase in water heating efficiency of about 12%. Moreover, the heat transfer along passageway P to water in the receptacle advantageously provides a temperature in the plenum chamber which is sufficiently low to permit installation of the water heating tank on combustible floors.

In connection with a water heating tank constructed in accordance with the preferred embodiment and providing the foregoing improved efficiency and exhaust temperature reduction, the water receptacle is of standard construction and the inner and outer side walls of the water receptacle are of at least fourteen gauge steel, having respective outer diameters of six and eighteen inches, passageway P has an axial length of about thirty-nine inches between the upper and lower ends thereof, and plenum chamber 30 has a diameter corresponding to that of the outer receptacle wall, an axial height of about one inch about the periphery thereof, and an axial height of about four inches adjacent the lower end of inner wall 12. Combustion chamber assembly 32 extends downwardly into passageway 32 about twenty inches, and sleeves 42 and 56 are twenty-nine gauge stainless steel. Refractory lining 52 has a radial thickness of about one-quarter inch, and lining 54 has a radial thickness of about one inch and an axial extent of about six inches. Baffle plate assembly 96 has a vertical height of about eighteen inches from the bottom wall of the plenum chamber, and outlet opening 66 from the plenum chamber has a vertical height of about one inch and the circumferential length of about six inches.

While considerable emphasis has been placed herein on the preferred structure of a liquid fuel-fired water heating tank according to the present invention, and the structural interrelationship between the component parts thereof, it will be appreciated that many embodiments of the present invention can be made and that many changes can be made in the preferred embodiment herein illustrated and described without departing from the principles of the invention. Accordingly, it is to be distinctly understood that the foregoing descriptive matter is to be interpreted merely as illustrative of the present invention and not as a limitation.

Having thus described the invention it is claimed:

1. A liquid fuel-fired water heating tank comprising housing means including an upwardly extending annular housing wall, an annular water receptacle in said housing means, said receptacle including radially spaced apart coaxial inner and outer side walls having corresponding upper and lower ends, said outer side wall being spaced inwardly from said housing wall, said receptacle further including annular upper and lower end walls, said upper end wall being between said upper ends of said side walls, said lower end of said outer side wall being spaced axially below said lower end of said inner side wall, said lower end wall of said receptacle being between said lower end of said inner side wall and said outer side wall at a location providing an axial portion of said outer side wall below said lower end wall, a planar bottom wall spaced below said lower end wall, said bottom wall extending transverse to the axis of said outer side wall and closing said lower end thereof, said lower end wall of said receptacle together with said planar bottom wall and said axial portion of said outer side wall defining a plenum chamber, said inner side wall opening downwardly into said plenum chamber and providing the only inlet passageway thereinto, combustion chamber means extending downwardly into said inner side wall of said receptacle from said upper end thereof, liquid fuel-fired burner means including burner tube means, means supporting said burner means above said upper ends of said inner and outer receptacle side walls with said burner tube means extending downwardly into said combustion chamber means, whereby combustion gases from combustion of fuel in said combustion chamber means during operation of said burner means flow downwardly from said combustion chamber means and through said inner side wall means of said receptacle therebelow into said plenum chamber, exhaust flue means including circumferentially spaced apart flue side walls extending upwardly along the outer surface of said outer side wall of said receptacle and an outer flue wall between said flue side walls and spaced radially outwardly from said outer surface of said outer side wall of said receptacle, said exhaust flue means having a circumferentially narrow inlet end opening radially into said plenum chamber through said axial portion of said outer side wall of said receptacle and an outlet end adjacent said upper end of said outer side wall of said receptacle and opening radially outwardly through said housing wall, said exhaust flue means providing the only exhaust passageway for combustion gases from said plenum chamber and said inlet end of said exhaust flue means restricting flow of said combustion gases from said plenum chamber into said exhaust flue, removable baffle means including a support member having a lower end resting on said planar bottom wall of said plenum chamber, said support member extending upwardly into said inner side wall of said receptacle, a plurality of baffle plates axially spaced apart on said support member along the length thereof, axially adjacent ones of said baffle plates being on opposite sides of said support member, said baffle plates being inclined downwardly and radially inwardly of said inner side wall of said receptacle, the lowermost one of said baffle plates being inclined downwardly and radially inwardly in the direction away from said inlet end of said exhaust flue, said means supporting said burner means including means removably mounting said burner means and said combustion chamber means on said water receptacle, and said combustion chamber means including coaxial first and second tubular portions of refractory material, said first portion surrounding said burner tube means and said second portion extending downwardly into said passageway from said first portion.

2. A water heating tank according to claim 1, wherein said outer flue wall and said flue side walls are lined with refractory insulating material.

* * * * *